United States Patent [19]

Beimesch et al.

[11] 4,077,891

[45] Mar. 7, 1978

[54] FABRIC TREATMENT COMPOSITIONS

[75] Inventors: Wayne Edward Beimesch, Covington, Ky.; Michael Andrew Walsh, Fairfield, Ohio

[73] Assignee: The Procter & Gamble Company, Cincinnati, Ohio

[21] Appl. No.: 716,302

[22] Filed: Aug. 20, 1976

[51] Int. Cl.[2] ..... D06M 13/20

[52] U.S. Cl. ..... 252/8.8; 8/115.6; 206/.5; 427/421

[58] Field of Search ..... 202/8.8, 8.6; 8/115.6; 427/421; 206/.5

[56] References Cited

U.S. PATENT DOCUMENTS

| | | | |
|---|---|---|---|
| 3,095,373 | 6/1963 | Blomfield | 252/8.8 |
| 3,442,692 | 5/1969 | Gaiser | 8/120 |
| 3,650,816 | 3/1972 | Rudy et al. | 252/8.6 |
| 3,686,025 | 8/1972 | Morton | 252/8.6 |
| 3,716,393 | 2/1973 | Baker et al. | 427/421 |

FOREIGN PATENT DOCUMENTS

| | | |
|---|---|---|
| 1,101,877 | 1/1968 | United Kingdom. |

OTHER PUBLICATIONS

Specl, et al., Textile Chemicals & Auxiliaries, Reinhold Publ. Co., (1958), pp. 114–117.

*Primary Examiner*—William E. Schulz
*Attorney, Agent, or Firm*—Douglas C. Mohl; Ronald L. Hemingway; Richard C. Witte

[57] ABSTRACT

A fabric softener/antistat composition comprising a formic acid salt of a long chain primary amine is applied to fabrics in an automatic laundry dryer.

21 Claims, No Drawings

FABRIC TREATMENT COMPOSITIONS

BACKGROUND OF THE INVENTION

The present invention encompasses articles and methods for providing softening and antistatic benefits to fabrics in an automatic laundry dryer. More specifically, damp fabrics are commingled with a formic acid salt of a long chain primary amine in an automatic clothes dryer and are provided with a soft, antistatic finish concurrently with the drying operation. The softening and antistatic formic acid salt of a long chain primary amine is preferably employed in combination with a dispensing means adapted for use in an automatic dryer.

Treatment in an automatic clothes dryer has been shown to be an effective means for imparting desirable tactile properties to fabrics. For example, it is becoming common to soften fabrics in an automatic clothes dryer rather than during the rinse cycle of a laundering operation. (See Gaiser, U.S. Pat. No. 3,442,692, issued May 6, 1969.)

Fabric "softness" is an expression well-defined in the art and is usually understood to be that quality of the treated fabric whereby its handle or texture is smooth, pliable and fluffy to the touch. Various chemical compounds have long been known to possess the ability to soften fabrics when applied to them during a laundering operation.

Fabric softness also connotes the absence of static "cling" in the fabrics, and the commonly used cationic fabric softeners provide both softening and antistatic benefits when applied to fabrics. Indeed, with fabrics such as nylon and polyester, the user is more able to perceive and appreciate an antistatic benefit than a true softening benefit.

Fatty alkyl cationic antistatic softening compounds and compositions designed for application to fabrics in an automatic dryer have been the subject of recent innovations. (See, for example, Furgal, U.S. Pat. No. 3,634,947, issued Jan. 18, 1972, and Morton, U.S. Pat. No. 3,686,025, issued Aug. 22, 1972.) Other fatty materials have been suggested for use as dryer-added fabric softeners. (See, for example, Hewitt et al., U.S. Pat. No. 3,676,199, issued July 11, 1972.) Included among these prior softening compositions are various glycerides in combination with oil-soluble, lower-ethoxylated surfactants. Triglyceride fabric treating agents are disclosed in Bernholz et al., U.S. Pat. No. 3,785,973, issued Jan. 15, 1974.

The use of primary amines and the salts of such amines as fabric conditioning agents for use in the washing and rinsing cycles of an automatic washer, as well as the drying cycle of an automatic dryer has been disclosed. (See for example, Blomfield, U.S. Pat. No. 3,095,373, issued June 25, 1963; Gaiser, U.S. Pat. No. 3,442,692, issued May 6, 1969; and South African Pat. No. 69/3923.) The use of primary amines in a dryer context, however, causes odor problems and paint softening. These problems are overcome with some salts, but not predictably so.

Formic acid salts of primary amines have also been used to treat fibers. (See for example Japanese Pat. No. 69-23,891 issued Oct. 9, 1969, and British Pat. No. 1,101,877, issued Jan. 31, 1968.) These references do not, however, disclose the advantages of using the formic acid salt in the dryer context over other acid salts and the straight amines or the superior fabric performance the formic acid salt gives as compared with quaternary ammonium salts in the dryer.

It is, therefore, an object of this invention to provide a superior article of manufacture adapted for imparting softness and antistatic benefits to fabrics in a clothes dryer, alternatively in a clothes washer, particularly in the rinse cycle of the washer, while not softening paint or having bad amine odors.

It is another object of this invention to provide a superior method for conditioning fabrics in a clothes dryer or a clothes washer.

These and other objects are obtained herein, as will be seen from the following disclosure.

SUMMARY OF THE INVENTION

The present invention encompasses an article of manufacture adapted for use in an automatic laundry dryer comprising a fabric softening amount of a formic acid salt of a long chain primary amine, as defined hereinafter, and a dispensing means which provides for release of an effective amount of said salt at automatic dryer operating temperatures, i.e., 35°-100° C.

The invention also encompasses a method for imparting a softening and antistatic effect to fabrics in an automatic dryer comprising commingling pieces of damp fabric by tumbling said fabrics under heat in a clothes dryer with an effective, i.e., softening, amount of the aforementioned formic acid salt of a long chain primary amine.

DETAILED DESCRIPTION OF THE INVENTION

The articles herein are fashioned from fabric softening compositions containing a formic acid salt of a long chain primary amine and from a dryer dispensing means, as more fully described hereinafter.

FABRIC SOFTENER COMPOSITIONS

Fabric softening compositions employed herein contain as their essential component a formic acid salt of a long chain primary amine. Such compositions can also contain a variety of optional materials.

FORMIC ACID SALT OF A LONG CHAIN PRIMARY AMINE

The essential fabric softener employed in the present invention is a salt formed as a result of the reaction between formic acid and a long chain primary amine. Formic acid is a staple item of commerce having the formula

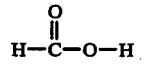

The primary amines useful herein are also stable items of commerce and correspond to the formula

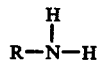

wherein R is an aliphatic group having from about 12 to 22 carbon atoms, preferably from about 16 to 22 carbon atoms. Examples of R groups are those derived from naturally occurring fatty oils. Tallow fatty acid and coconut fatty acid are two of such materials with tallow having predominantly 16 to 18 carbon atoms and coconut having predominantly 12 to 14 carbon atoms. Other sources of suitable R groups are lauric, myristic, palmitic, stearic and behenic acids.

The formate salt can be formed by a simple additional reaction, well known in the art, wherein the primary amine is dissolved in a solvent such as methanol, ethanol, propanol, etc., and the formic acid is added to the amine solution. The amount of formic acid is preferably equal to the amount of amine on a molar basis. This is true since it is desirable to eliminate free formic acid and free amine from the composition. The reaction which takes place is as follows:

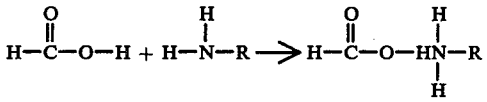

The salt precipitates from solution and may be recovered either by filtration and/or evaporation of the solvent. The melting point of the material lies in the range of 73° C to 82° C, which is appropriate for use in the dryer.

Formic acid salts of primary amines are preferred over salts of other acids for a number of reasons. First, the reaction between the acid and the amine is more complete, resulting in less amine/acid odor. Second, the fabric conditioning properties of the formate salt are better. Third, the melting point of the formate salt matches more closely the operating temperatures of an automatic clothes dryer.

The addition of a small amount of a multicarboxylic group acid may be advantageous, however. For example, the use of a small amount of citric acid can serve as a buffer and ensure that the level of free amine is kept to a minimum.

OPTIONAL SOFTENING COMPOSITION COMPONENTS

Various additives can be used in combination with the formic acid salt of a long chain primary amine in the softening compositions herein. Although not essential to the invention herein, certain fabric treating additives are particularly desirable and useful, e.g., perfumes, brightening agents, shrinkage controllers, spotting agents and the like.

Additional fabric softener/antistat agents may also be used in combination with the formate salt. These agents are generally nonionic or cationic in nature.

The most common type of cationic softener/antistat materials are the cationic nitrogen-containing compounds such as quaternary ammonium compounds and amines having one or two straight-chain organic groups of at least eight carbon atoms. Preferably, they have one or two such groups of from 12 to 22 carbon atoms. Preferred cation-active softener compounds include the quaternary ammonium softener/antistat compounds corresponding to the formula

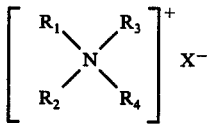

wherein $R_1$ is hydrogen or an aliphatic group of from 1 to 22 carbon atoms; $R_2$ is an aliphatic group having from 12 to 22 carbon atoms; $R_3$ and $R_4$ are each alkyl groups of from 1 to 3 carbon atoms; and X is an anion selected from halogen, acetate, phosphate, nitrate and methyl sulfate radicals.

Because of their excellent softening efficacy and ready availability, preferred cationic softener/antistat compounds of the invention are the dialkyl dimethyl ammonium methyl sulfates, wherein the alkyl groups have from 12 to 22 carbon atoms and are derived from long-chain fatty acids, such as hydrogenated tallow. As employed herein, alkyl is intended as including unsaturated compounds such as are present in alkyl groups derived from naturally occurring fatty oils. The term "tallow" refers to fatty alkyl groups derived from tallow fatty acids. Such fatty acids give rise to quaternary softener compounds wherein $R_1$ and $R_2$ have predominantly from 16 to 18 carbon atoms. The term "coconut" refers to fatty acid groups from coconut oil fatty acids. The coconut-alkyl $R_1$ and $R_2$ groups have from about 8 to about 18 carbon atoms and predominate in $C_{12}$ to $C_{14}$ alkyl groups. Representative examples of quaternary softeners of the invention include tallow trimethyl ammonium chloride; ditallow dimethyl ammonium chloride; ditallow dimethyl ammonium methyl sulfate; dihexadecyl dimethyl ammonium chloride; di(hydrogenated tallow) dimethyl ammonium chloride; dioctadecyl dimethyl ammonium chloride; dieicosyl dimethyl ammonium chloride; didocosyl dimethyl ammonium chloride; di(hydrogenated tallow) dimethyl ammonium methyl sulfate; dihexadecyl diethyl ammonium chloride; dihexadecyl dimethyl ammonium acetate; ditallow dipropyl ammonium phosphate; ditallow dimethyl ammonium nitrate; di(coconut-alkyl) dimethyl ammonium chloride.

An especially preferred class of quaternary ammonium softener/antistats of the invention correspond to the formula

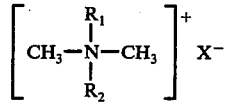

wherein $R_1$ and $R_2$ are each straight chain aliphatic groups of from 12 to 22 carbon atoms and X is halogen, e.g., chloride or methyl sulfate. Especially preferred are ditallow dimethyl ammonium methyl sulfate (or chloride) and di(hydrogenated tallow-alkyl) dimethyl ammonium methyl sulfate (or chloride) and di(coconut-alkyl) dimethyl ammonium methyl sulfate (or chloride), these compounds being preferred from the standpoint of excellent softening properties and ready availability.

Other suitable cation-active softener/antistat compounds herein are the quaternary imidazolinium salts. Preferred salts are those conforming to the formula

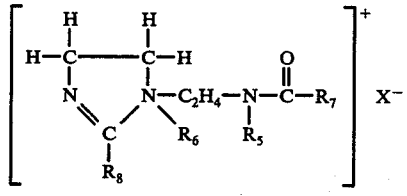

wherein $R_6$ is an alkyl containing from 1 to 4, preferably from 1 to 2 carbon atoms, $R_5$ is an alkyl containing from 1 to 4 carbon atoms or a hydrogen radical, $R_8$ is an alkyl containing from 1 to 22, preferably at least 15 carbon atoms or a hydrogen radical, $R_7$ is an alkyl containing from 8 to 22, preferably at least 15 carbon atoms, and X is an anion, preferably methylsulfate or chloride ions. Other suitable anions include those disclosed with reference to the cationic quaternary ammonium fabric antistat/softeners described hereinbefore. Particularly preferred are those imidazolinium compounds in which both $R_7$ and $R_8$ are alkyls of from 12 to 22 carbon atoms, e.g., 1-methyl-1-[(stearoylamide)ethyl]-2-heptadecyl-4,5-dihydroimidazolinium methyl sulfate; 1-methyl-1-[(palmitoylamide)ethyl]-2-octadecyl-4,5-dihydroimidazolinium chloride and 1-methyl-1-[(tallowamide) ethyl]-2-tallow-imidazolinium methyl sulfate.

Other cationic quaternary ammonium fabric softener-/antistats which are useful herein include, for example, alkyl ($C_{12}$ to $C_{22}$)-pryidinium chlorides, alkyl ($C_{12}$ to $C_{22}$)-alkyl ($C_1$ to $C_3$)-morpholinium chlorides, and quaternary derivatives of amino acids and amino esters.

Nonionic fabric softener/antistat materials include a wide variety of materials including sorbitan esters, fatty alcohols and their derivatives, diamine compounds and the like. One preferred type of nonionic fabric antistat/-softener material comprises the esterified cyclic dehydration products of sorbitol, i.e., sorbitan ester. Sorbitol, itself prepared by catalytic hydrogenation of glucose, can be dehydrated in well-known fashion to form mixtures of cyclic 1,4- and 3,6-sorbitol anhydrides and small amounts of isosorbides. (See Brown; U.S. Pat. No. 2,322,821; issued June 29, 1943). The resulting complex mixtures of cyclic anhydrides of sorbitol are collectively referred to herein as "sorbitan". It will be recognized that this "sorbitan" mixture will also contain some free uncyclized sorbitol.

Sorbitan ester fabric softener/antistat materials useful herein are prepared by esterifying the "sorbitan" mixture with a fatty acyl group in standard fashion, e.g., by reaction with a fatty ($C_{10}$–$C_{24}$) acid or fatty acid halide. The esterification reaction can occur at any of the available hydroxyl groups, and various mono-, di-, etc., esters can be prepared. In fact, complex mixtures of mon-, di-, tri-, and tetra-esters almost always result from such reactions, and the stoichiometric ratios of the reactants can simply be adjusted to favor the desired reaction product.

The foregoing complex mixtures of esterified cyclic dehydration products of sorbitol (and small amounts of esterified sorbitol) are collectively referred to herein as "sorbitan esters". Sorbitan mono- and di-esters of lauric, myristic, palmitic, stearic and behenic acids are particularly useful herein for conditioning the fabrics being treated. Mixed sorbitan esters, e.g., mixtures of the foregoing esters, and mixtures prepared by esterifying sorbitan with fatty acid mixtures such as the mixed tallow and hydrogenated palm oil fatty acids, are useful herein and are economically attractive. Unsaturated $C_{10}$–$C_{18}$ sorbitan esters, e.g., sorbitan mono-oleate, usually are present in such mixtures. It is to be recognized that all sorbitan esters, and mixtures thereof, which are essentially water-insoluble and which have fatty hydrocarbyl "tails", are useful fabric antistat/softener materials in the context of the present invention.

The preferred alkyl sorbitan ester fabric softener/antistat materials herein comprise sorbitan monolaurate, sorbitan monomyristate, sorbitan monopalmitate, sorbitan monostearate, sorbitan monobehenate, sorbitan dilaurate, sorbitan dimyristate, sorbitan dipalmitate, sorbitan distearate, sorbitan dibehenate, and mixtures thereof, the mixed coconutalkyl sorbitan mono- and di-esters and the mixed tallowalkyl sorbitan mono- and di-esters. The tri- and tetra-esters of sorbitan with lauric, myristic, palmitic, stearic and behenic acids, and mixtures thereof, are also useful herein.

Another useful type of nonionic fabric softener/antistat material encompasses the substantially water-insoluble compounds chemically classified as fatty alcohols. Mono-ols, di-ols, and poly-ols having the requisite melting points and water-insolubility properties set forth above are useful herein. Such alcohol-type fabric conditioning materials also include the mono- and di-fatty glycerides which contain at least one "free" OH group.

All manner of water-insoluble, high melting alcohols (including mono- and di-glycerides), are useful herein, inasmuch as all such materials are fabric substantive. Of course, it is desirable to use those materials which are colorless, so as not to alter the color of the fabrics being treated. Toxicologically acceptable materials which are safe for use in contact with skin should be chosen.

A preferred type of unesterified alcohol useful herein includes the higher melting members of the so-called fatty alcohol class. Although once limited to alcohols obtained from natural fats and oils, the term "fatty alcohols" has come to mean those alcohols which correspond to the alcohols obtainable from fats and oils, and all such alcohols can be made by synthetic processes. Fatty alcohols prepared by the mild oxidation of petroleum products are useful herein.

Another type of material which can be classified as an alcohol and which can be employed as the fabric softener/antistat material in the instant invention encompasses various esters of polyhydric alcohols. Such "ester-alcohol" materials which have a melting point within the range recited herein and which are substantially water-insoluble can be employed herein when they contain at least one free hydroxyl group, i.e., when they can be classified chemically as alcohols.

The alcoholic di-esters of glycerol useful herein include both the 1,3-di-glycerides and the 1,2-di-glycerides. In particular, di-glycerides containing two $C_8$–$C_{20}$, preferably $C_{10}$–$C_{18}$, alkyl groups in the molecule are useful fabric conditioning agents.

Non-limiting examples of ester-alcohols useful herein include: glycerol-1,2-dilaurate; glycerol-1,3-dilaurate; glycerol-1,2-dimyristate; glycerol-1,3-dimyristate; glycerol-1,2-dipalmitate; glycerol-1,3-dipalmitate; glycerol-1,2-distearate and glycerol-1,3-distearate. Mixed glycerides available from mixed tallowalkyl fatty acids, i.e., 1,2-ditallowalkyl glycerol and 1,3-ditallowalkyl glycerol, are economically attractive for use herein. The foregoing ester-alcohols are preferred for use herein due to their ready availability from natural fats and oils.

Mono- and di-ether alcohols, especially the $C_{10}$–$C_{18}$ di-ether alcohols having at least one free -OH group, also fall within the definition of alcohols useful as fabric softener/antistat materials herein. The ether-alcohols can be prepared by the classic Williamson ether synthesis. As with the ester-alcohols, the reaction conditions are chosen such that at least one free, unetherified -OH group remains in the molecule.

Ether-alcohols useful herein include glycerol-1,2-dilauryl ether; glycerol-1,3-distearyl ether; and butane tetra-ol-1,2,3-trioctanyl ether.

While not essential, liquids which serve as a carrier for the softening agents and other materials can also be employed as part of the softening compositions herein. Such liquids can be used, for example, to more evenly impregnate an absorbent substrate with the softening composition when such an absorbent substrate is employed (as discussed hereinafter) as the dispensing means for the instant compositions. When a liquid carrier is so used, it should preferably be inert or stable with the fabric softeners. Moreover, the liquid carrier used in substrate impregnation should be substantially evaporated at room temperatures, and the residue (i.e., the softening agent and other optional materials) should then be sufficiently hardened so as not to run or drip off the substrate, or cause the substrate to stick together when folded. Isopropyl alcohol or isopropyl alcohol/-water mixtures are the preferred liquid carriers for substrate impregnation purposes. Methanol, ethanol, acetone, ethylene glycol, propylene glycol, alcohol ethoxylate nonionic surfactants and/or liquified fluorocarbons such as dichlorodifluoroethane and dichlorodifluoromethane can also be used as carriers either for dispensing the softening compositions in the dryer, for introducing the softening compositions into the dryer dispensing means or for facilitating release of the softening compositions from the dryer dispensing means.

Other additives can include anti-creasing agents, finishing agents, fumigants, lubricants, fungicides, and sizing agents. Specific examples of useful additives disclosed herein can be found in any current Year Book of the American Association of Textile Chemists and Colorists. Any additive used should be compatible with the softening agents.

The amounts of some additives (e.g., perfume and brighteners) that are generally used in combination with the softening agents are small, being in the range of from 0.01% to 10% by weight of the softening composition. Other additives such as the optional cationic antistat/softener agents and liquid carriers can be present in larger amounts. Such cationic and/or liquid carrier materials can be present in fabric softening compositions to the extent of from about 0.01% to 50% or more by weight of the softening composition.

A highly preferred softening composition herein contains from about 50% to 100% by weight of the composition of the essential formic acid salt of a long chain primary amine and from about 0% to 50% by weight of the composition of an optional softener/antistat agent. Preferred additional agents are ditallow dimethyl ammonium methyl sulfate, sorbitan monostearate and mixtures of these materials. Highly preferred mixtures are those wherein the ratios of the two are in the range of about 80/20 to about 20/80.

A liquid carrier will, of course, be present in the softening composition in relatively large amounts, especially if the presence of such a carrier is useful in dispensing the softening composition in the dryer. (In an aerosol device, for example.)

DISPENSING MEANS

The primary amine formate-containing softening compositions can be employed by simply adding a measured amount into the dryer, e.g., as liquid dispersion. However, in a preferred embodiment, the softeners are provided as an article of manufacture in combination with a dispensing means which effectively releases the formate-containing composition in an automatic clothes dryer. Such dispensing means can be designed for single usage or for multiple uses.

One such article comprises a sponge material releasably enclosing enough softener composition to effectively impart fabric softness during several cycles of clothes. This multiuse article can be made by filling a hollow sponge with about 20 grams of the formate salt. In use, the salt melts and leaches out through the pores of the sponge to soften fabrics. Such a filled sponge can be used to treat several loads of fabrics in conventional dryers, and has the advantage that it can remain in the dryer after use and is not likely to be misplaced or lost.

Another article comprises a cloth or paper bag releasably enclosing the formate salt-containing softening composition and sealed with the hardened salt. The action and heat of the dryer opens the bag and releases the salt to perform its softening function.

Still another article comprises an aerosol cannister containing the above described softening compositions under pressure. The compositions can be dispensed from this aerosol article onto or into the dryer in the manner more fully described in Rudy et al, U.S. Pat. No. 3,650,816, issued Mar. 21, 1972, incorporated herein by reference.

Other devices and articles suitable for dispensing the softening material into automatic dryers include those described in Dillarstone, U.S. Pat. No. 3,736,668, issued June 5, 1973; Compa et al, U.S. Pat. No. 3,701,202, issued Oct. 31, 1972; Furgal, U.S. Pat. No. 3,634,947, issued Jan. 18, 1972; Hoeflin, U.S. Pat. No. 3,633,538, issued Jan. 11, 1972 and Rumsey, U.S. Pat. No. 3,435,537, issued Apr. 1, 1969. All of these patents are incorporated herein by reference.

A highly preferred article herein comprises the formate salt-containing composition releasably affixed to a sheet of paper or woven or nonwoven cloth substrate or a sheet of foamed plastic such as polyurethane. When such an article is placed in an automatic laundry dryer, the heat and tumbling action of the dryer removes the composition from the substrate and deposits it on the fabrics.

The sheet conformation has several advantages. For example, effective amounts of the formate salt for use in conventional dryers can be easily sorbed onto and into the sheet substrate by a simple dipping or padding process. Thus, the user need not measure the amount of salt necessary to obtain fabric softness. Additionally, the flat configuration of the sheet provides a large surface area which results in efficient release of the softener materials onto fabrics by the tumbling action of the dryer.

The water-insoluble paper, or woven or non-woven substrates used in the articles herein can have a dense, or more preferably, open or porous structure. Examples of suitable materials which can be used as substrates herein include paper, woven cloth, and non-woven cloth. The term "cloth" herein means a woven or non-woven substrate for the articles of manufacture, as distinguished from the term "fabric" which encompasses the clothing fabrics being dried in an automatic dryer.

Highly preferred paper, woven or non-woven "absorbent" substrates useful herein are fully disclosed in Morton, U.S. Pat. No. 3,686,025, issued Aug. 22, 1972, incorporated herein by reference. It is known that most substances are able to absorb a liquid substance to some degree; however, the term "absorbent" as used herein, is intended to mean a substance with an absorbent capacity (i.e., a parameter representing a substrate's ability to take up and retain a liquid) from 2 to 25 times its weight of water.

Determination of absorbent capacity values is made by using the capacity testing procedures described in U.S. Federal Specifications UU-T-595b, modified as follows:

(1) tap water is used instead of distilled water;

(2) the specimen is immersed for 30 seconds instead of 3 minutes;

(3) draining time is 15 seconds instead of 1 minute; and (4) the specimen is immediately weighed on a torsion balance having a pan with turned-up edges.

Absorbent capacity values are then calculated in accordance with the formula given in said Specification. Based on this test, one-ply, dense bleached paper (e.g., kraft or bond having a basis weight of about 32 pounds per 3,000 square feet) has an absorbent capacity of 3.5 to 4; commercially available household one-ply toweling paper has a value of 5 to 6; and commercially available two-ply household toweling paper has a value of 7 to about 9.5.

Using a substrate with an absorbent capacity of less that 2 tends to cause too rapid release of the softening agent from the substrate resulting in several disadvantages, one of which is uneven softening of the fabrics. Using a substrate with an absorbent capacity over 25 is undesirable, inasmuch as too little of the softening agent is released to soften the fabrics in optimal fashion during a normal drying cycle. If the substrate is a woven or nonwoven cellulosic cloth or paper, rather than a foamed plastic material, the absorbency should preferably be in the range of 2 to 15, most preferably between 5 and 7. For foamed plastics, the absorbency is preferably in the range of from about 15 to 25.

The use of the dense, one-ply or ordinary kraft or bond paper for the softening article substrate can result in increased staining of certain types of treated fabrics. This staining is caused by the low absorbent capacity of the paper substrate.

The softening composition on dense paper can be rapidly and unevenly released in excessive quantities when subjected to customary dryer temperatures, with the result that treated fabrics can become stained at points of contact with the softener-coated paper. Fabric staining can be minimized by employing a substrate having an absorbent capacity in the range of 2 to 25, such that less of the softening composition is released at any given point in time when contacted with the fabric being treated.

As noted above, suitable materials which can be used as a substrate in the invention herein include, among others, sponges, paper, and woven and non-woven cloth, all having the necessary absorbency requirements defined above. The preferred substrates of the softening compositions herein are cellulosic, polyester or polyester/cellulosic blends, particularly multi-ply paper and nonwoven cloth.

More specifically, a preferred paper substrate comprises a compressible, laminated, calendered, multi-ply, absorbent paper structure. Preferably, the paper structure has 2 or 3 plies and a total basis weight of from 14 to 90 pounds per 3,000 square feet and absorbent capacity values within the range of 7 to 10. Each ply of the preferred paper structure has a basic weight of about 7 to 30 pounds per 3,000 square feet, and the paper structure can consist of plies having the same or different basis weights. Each ply is preferably made from a creped, or otherwise extensible, paper with a creped percentage of about 15% to 40% and a machine direction (MD) tensile and cross-machine (CD) tensile strength of from about 100 to 1,500 grams per square inch of paper width. The two outer plies of a 3-ply paper structure or each ply of a 2-ply paper structure are embossed with identical repeating patterns consisting of about 16 to 200 descrete protuberances per square inch, raised to a height of from about 0.010 inch to 0.40 inch above the surface of the unembossed paper sheet. From about 10% to 60% of the paper sheet surface is raised. The distal ends (i.e., the ends away from the unembossed paper sheet surface) of the protuberances on each ply are mated and adhesively joined together, thereby providing a preferred paper structure exhibiting a compressive modulus of from about 200 to 800 inch-grams per cubic inch and Handle-O-Meter (HOM) MD and CD values of from about 10 to 130.

Suitable adhesives for multi-ply paper are known in the art and include water, starches, wet-strength resins, and polyvinyl acetates. A particularly suitable adhesive is prepared by heating from about 2 to about 4 parts by weight of substantially completely hydrolyzed polyvinyl alcohol resin in from about 96 to about 98 parts by weight of water. Preferably, about 0.03 pound of adhesive solids are used to join 3,000 square feet of the embossed plies, with the adhesive being applied to the distal surfaces of the protuberances of one or all plies.

The compressive modulus values which define the compressive deformation characteristics of a paper structure compressively loaded on its opposing surfaces, the HOM values which refer to the stiffness or handle of a paper structure, the MD and CD HOM values which refer to HOM values obtained from paper structure samples tested in a machine and cross-machine direction, the methods of determining these values, the equipment used, and a more detailed disclosure of the paper structure preferred herein, as well as methods of this preparation, can be found in Wells; U.S. Pat. No. 3,414,459, issued Dec. 3, 1968, the disclosure of which is incorporated herein by reference.

The preferred non-woven cloth substrates used in the invention herein can generally be defined as adhesively bonded fibrous or filamentous products having a web or carded fiber structure (where the fiber strength is suitable to allow carding), or comprising fibrous mats in which the fibers or filaments are distributed haphazardly or in random array (i.e., an array of fibers in a carded web wherein partial orientation of the fibers is frequently present, as well as a completely haphazard distributional orientation), or substantially aligned. The fibers or filaments can be natural (e.g., wool, silk, jute, hemp, cotton, linen, sisal, or ramie) or synthetic (e.g., rayon, cellulose ester, polyvinyl derivatives, poly-olefins, polyamides, or polyesters).

Methods of making non-woven cloths are not a part of this invention and, being well known in the art, are not described in detail herein. Generally, however, such cloths are made by air- or water-laying processes in which the fibers or filaments are first cut to desired lengths from long strands, passed into a water or air stream, and then deposited onto a screen through which the fiber-laden air or water is passed. The deposited fibers or filaments are then adhesively bonded together, dried, cured, and otherwise treated as desired to form the non-woven cloth. Non-woven cloths made of polyesters, polyamides, vinyl resins, and other thermoplastic fibers can be spun-bonded, i.e., the fibers are spun out onto a flat surface and bonded (melted) together by heat or by chemical reactions.

The absorbent properties preferred herein are particularly easy to obtain with non-woven cloths and are provided merely by building up the thickness of the cloth, i.e., by superimposing a plurality of carded webs or mats to a thickness adequate to obtain the necessary absorbent properties, or by allowing a sufficient thickness of the fibers to deposit on the screen. Any diameter or denier of the fiber (generally up to about 10 denier) can be used, inasmuch as it is the free space between each fiber that makes the thickness of the cloth directly related to the absorbent capacity of the cloth, and which, further, makes the non-woven cloth especially suitable for impregnation with a softening composition by means of intersectional or capillary action. Thus, any thickness necessary to obtain the required absorbent capacity can be used.

The choice of binder-resins used in the manufacture of non-woven cloths can provide substrates possessing a variety of desirable traits. For example, the absorbent capacity of the cloth can be increased, decreased, or regulated by respectively using a hydrophilic binder-resin, a hydrophobic binder-resin, or a mixture thereof, in the fiber bonding step. Moreover, the hydrophobic binder-resin, when used singly or as the predominant compound of a hydrophobic-hydrophilic mixture, provides non-woven cloths which are especially useful as substrates when the softening articles herein are used with damp fabrics in an automatic dryer.

When the substrate for the softening articles herein is a non-woven cloth made from fibers deposited haphazardly or in random array on the screen, the articles exhibit excellent strength in all directions and are not prone to tear or separate when used in the automatic clothes dryer.

Preferably, the non-woven cloth is water-laid or air-laid and is made from cellulosic fibers, particularly from regenerated cellulose or rayon. Such non-woven cloth can be lubricated with any standard textile lubricant. Preferably, the fibers are from 3/16 inch to 2 inches in length and are from 1.5 to 5 denier. Preferably, the fibers are at least partially oriented haphazardly, particulary substantially haphazardly, and are adhesively bonded together with a hydrophobic or substantially hydrophobic binder-resin, particularly with a nonionic self-crosslinking acrylic polymer or polymers. Preferably, the cloth comprises about 70% fiber and 30% binder-resin polymer by weight and has a basis weight of from about 18 to 24 grams per square yard.

The preferred fabric softening articles of the present invention are structured to be compatible with conventional laundry dryer designs. While it is preferred to employ the articles of the present invention in an automatic laundry dryer, other equivalent machines can be employed, and in some instances, heat and drying air may be omitted for part or all of the cycle. Generally, however, heated air will be employed and such air will be circulated frequently in the dryer. Normally, there are from about 5 to 50 volume changes of drying air in the dryer drum per minute and the air moves at about 125 to 175 cubic feet per minute. These changing volumes of air create a drawing or suction effect which can, especially with small fabric loads, cause an item such as a sock, handkerchief or the like, or a fabric conditioning article, to be disposed on the surface of the air outlet of the dryer. A usual load of fabrics of from about 4 to 12 pounds dry weight will fill from about 10% to 70% of the volume of most dryers and will normally pose little difficulty. A sufficient number of tumbling items will normally be present to prevent any item from being drawn to the exhaust outlet or to cause it to be removed from the outlet. In the event, however, a fabric softening article is caused to be disposed in relation to the air exhaust outlet in such a manner as to cause blockage of passing air, undesirable temperature increases can result. In the case of fabric softening articles prepared from the normally solid or waxy softeners such as the formate salt which soften or melt under conditions of heat, the article may tend to adhere to an exhaust outlet.

The problem of blockage can be solved by providing openings in the article in the manner described in two U.S. patents of A. R. McQueary, U.S. Pat. No. 3,944,694 and U.S. Pat. No. 3,956,556, issued Mar. 16, 1976, and May 11, 1976, respectively, both incorporated herein by reference. More specifically, slits or holes are cut through the substrate The slit openings are provided in the preferred fabric softening articles of the invention for two principal purposes Importantly the slits permit passage of air in the event the article is placed in a blocking relationship to the air exhaust outlet. Moreover, the slit openings provide a degree of flexibility or resiliency which causes the article to crumple or pucker. The effect of such crumpling is that only a portion of the air exhaust outlet will be covered by the softening article in the event it is carried by the moving air stream to the exhaust outlet. Moreover, the crumpled article is more readily removed by tumbling fabrics than would be the case if the article were placed in a flat relationship to the exhaust outlet.

The type and number of slit openings can vary considerably and will depend upon the nature of the substrate material, its inherent flexibility or rigidity, the nature of the softening agent carried therein or thereon, and the extent to which increased passage of air therethrough is desired. The preferred articles of this invention can comprise a large number of small slits of various types or configurations, or fewer larger slits. For example, a single rectilinear or wavy slit, or a plurality thereof, confined to within the area of a sheet and extending close to opposite edges of the article, can be employed. By maintaining a border around all edges of the softening article, a desired degree of flexibility and surface area availability to tumbling fabrics can be maintained. While, for example, rectilinear slits can be cut into a softening article completely to the edges of the article, confinement of the slits to within the area of the article will be preferred where the convenience of packaging the softening article in roll form is desired.

As an alternative to slits, the article can be provided with one or more openings having a diameter of from about 0.02 inches to about 4 inches, from about 5% to about 40% of the surface area of the article comprising said openings. The openings can be disposed in any convenient relationship to one another but it is simplest, from a manufacturing standpoint, to punch the openings through the substrate in evenly spaced rows.

ARTICLE MANUFACTURE

The articles herein comprise primary amine formate salt-containing softener compositions in combination with any dispensing means suitable for releasing softening agent at temperatures encountered in automatic laundry dryers. Preferred articles herein are those wherein the softening composition is impregnated into or coated onto an absorbent substrate. The impregnation or coating can be accomplished in any convenient manner, and many methods are known in the art. For example, the softening composition, in liquid form, can be sprayed onto a substrate or can be added to a wood-pulp slurry from which the substrate is manufactured.

Impregnating, rather than coating, the substrate with the softener composition is highly preferred for optimal softening with minimal fabric standing. The term "coating" connotes the adjoining of one substance to the external surface of another; "impregnating" is intended to mean the permeation of the entire substrate structure, internally as well as externally. One factor affecting a given substrate's absorbent capacity is its free space. Accordingly, when a softening composition is applied to an absorbent substrate, it penetrates into the free space; hence, the substrate is deemed impregnated. The free space in a substrate of low absorbency, such as a one-ply kraft or bond paper, is very limited; such a substrate, is therefore, termed "dense". Thus, while a small portion of the softening composition penetrates into the limited free space available in a dense substrate, a rather substantial balance of the softener composition does not penetrate and remains on the surface of the substrate so that it is deemed a coating. The difference between coating and impregnation is believed to explain why the softener-impregnated sheet substrates of the invention herein eliminate or substantially reduce the staining of fabrics observed when a softener-coated dense substrate is utilized.

In one method of making the preferred softener-impregnated absorbent sheet substrate, a softener composition containing a primary amine formate salt alone or with the optional additives is applied to absorbent paper or non-woven cloth by a method generally known as padding. The softening composition is preferably applied in liquid form to the substrate. Thus, the formate salt-containing softener compositions which are normally solid at room temperature should first be melted and/or solvent treated with one of the liquid carriers mentioned hereinbefore. Methods of melting the softener composition and/or for treating the softener composition with a solvent are known and can be done to provide a satisfactory softener-treated substrate.

In another preferred method, the formate salt-containing softener composition in liquified form is placed in a pan or trough which can be heated to maintain the softener composition in liquid form. The liquid softener composition contains any of the desired optional additives. A roll of absorbent paper (or cloth) is then set up on an apparatus so that it can unroll freely. As the paper or cloth unrolls, it travels downwardly and, submersed, passes through the pan or trough containing the liquid softener at a slow enough speed to allow sufficient impregnation. The absorbent paper or cloth then travels upwardly and through a pair of rollers which remove excess bath liquid and provide the absorbent paper or cloth with about 1 to about 12 grams of the formate salt softening agent per 100 in.$^2$ to 150 in.$^2$ of substrate sheet. The impregnated paper or cloth is then cooled to room temperature, after which it can be folded, cut or perforated at uniform lengths, and subsequently packaged and/or used.

The rollers used resemble "squeeze rolls" used by those in the paper and paper-making art; they can be made of hard rubber or steel. Preferably, the rollers are adjustable, so that the opening between their respective surfaces can be regulated to control the amount of the softener composition liquid on the paper or cloth.

In another method of impregnation, the softener composition, in liquid form, is sprayed onto absorbent paper or cloth as it unrolls and the excess softener is then squeezed off by the use of squeeze rollers or by a doctor-knife. Other variations include the use of metal "nip" rollers on the leading or entering surfaces of the sheets onto which the softening composition is sprayed; this variation allows the absorbent paper or cloth to be treated, usually on one side only, just prior to passing between the rollers whereby excess softener is squeezed off. This variation can optionally involve the use of metal rollers which can be heated to maintain the softener composition in the liquid phase. A further method involves separately treating a desired number of the individual plies of a multi-ply paper and subsequently adhesively joining the plies with a known adhesive-joinder compound; this provides an article which can be untreated on one of its outer sides, yet contains several other plies, each of which is treated on both sides.

In applying the softener composition to the absorbent substrate, the amount of softener composition (containing up to 100% by weight of formate salt) impregnated into or coated onto the absorbent substrate is conveniently in the weight ratio range of from about 10:1 to 0.5:1 based on the ratio of total softener composition to dry, untreated substrate (fiber plus binder). Preferably, the amount of the softener composition ranges from about 5:1 to about 1:1, most preferably from about 3:1 to 1:1, by weight of the dry, untreated substrate.

Following application of the liquified softener composition, the articles are held at room temperature until the softener composition solidifies. The resulting dry articles, prepared at the softener composition:substrate ratios set forth above, remain flexible; the sheet articles are suitable for packaging in rolls. The sheet articles can optionally be slitted or punched to provide a non-blocking aspect at any convenient time during the manufacturing process.

The most highly preferred articles herein are those where the formate salt-containing softener composition is releasably affixed to a woven or nonwoven cloth substrate of the type disclosed hereinabove having an absorbent capacity of from about 2 to about 15. A highly preferred substrate for such an article has an absorbent capacity of from about 5 to 7. The most highly preferred substrate for the articles comprises a water-laid or air-laid non-woven cloth consisting essentially of cellulosic fibers, said fibers having a length of about 3/16 inch to about 2 inches and a denier from about 1.5 to about 5, said fibers being at least partially oriented haphazardly, and adhesively bonded together with a binder-resin. Such water-laid or air-laid non-woven cloths can easily be prepared having the preferred absorbent capacities set forth above.

The most highly preferred articles herein are those wherein the flexible substrate is provided with openings sufficient in size and number to reduce restriction by said article of the flow of air through the automatic dryer. Articles wherein the openings comprise a plurality of rectilinear slits extending along one dimension of the substrate, especially those wherein the slits extend to within 1 inch from at least one edge of said dimension of the substrate, articles wherein the slits comprise a plurality of curvilinear slits in a continuous pattern of U-shaped or C-shaped slits, and articles wherein the openings comprise circular holes, are highly preferred herein.

It is most convenient to provide an article in the form of a non-blocking sheet substrate having the physical parameters noted hereinabove, said substrate having an area of from about 50 in.$^2$ to about 200 in.$^2$, containing from about 1.5 grams to about 7.5 of the formate salt releasably impregnated in said substrate. Such articles can be provided with, as additional components, other fabric treating additives of the type disclosed hereinabove. The articles are provided with openings such as the holes or slits described hereinabove, said openings comprising from about 0.5% to about 75%, preferably 5% to about 40%, of the area of the article, said openings being so disposed as to provide a non-blocking effect.

USAGE

In the method aspect of this invention the formate salt softeners are used in an effective amount to soften and condition fabrics in an automatic laundry dryer. The effective, i.e., softening and static-controlling, amount of the formate salt used in the manner of this invention will depend somewhat on the type of fabric being treated and the dampness of the surrounding atmosphere. For example, it is well-known that under conditions of low humidity, static control in fabrics is somewhat more difficult to achieve than under conditions of high humidity.

For most purposes, the formate salt is applied to fabrics at a rate of about 0.01 gram to about 12 grams, preferably 1 g. to about 4 g., per 5 lbs. of fabrics on a dry fabric weight basis. Higher usage rates can be employed, if desired, but can result in an undesirable greasy feel on the fabrics.

The method herein is carried out in the following manner. Damp fabrics, usually containing from about 1 to about 1.5 times their weight of water, are placed in the drum of an automatic clothes dryer. In practice, such damp fabrics are commonly obtained by laundering, rinsing and spin-drying the fabrics in a standard washing machine. The formate salt either alone or in combination with other additives is simply spread uniformly over all fabric surfaces, for example, by sprinkling a formate salt-containing composition onto the fabrics from a shaker device. Alternatively, the formate salt-containing compositions can be sprayed into the dryer containing the fabrics or onto the dryer drum. The dryer is then operated in standard fashion to dry the fabrics, usually at a temperature from about 50° C to about 80° C for a period from about 10 minutes to about 60 minutes, depending on the fabric load and type. On removal from the dryer, the dried fabrics are softened. Moreover, the fabrics instantaneously sorb a minute quantity of water which increases the electrical conductivity of the fabric surfaces, thereby quickly and effectively dissipating static charge.

In a preferred mode, the present process is carried out by fashioning an article comprising the substrate-like dispensing means of the type hereinabove described in releasable combination with a formate salt -containing softener composition. This article is simply added to a clothes dryer together with the damp fabrics to be treated. The heat and tumbling action of the revolving dryer drum evenly distributes the softener composition over all fabric surfaces, and dries the fabrics. Alternatively, the substrate-like dispensing means may be put in at the start of the washer cycle or preferably at the start of the rinse cycle.

The following are nonlimiting examples of the instant articles and methods.

EXAMPLE I

A formic acid salt of a long chain primary amine, stearyl amine formate, is made as follows:

(A) 275 grams of stearyl amine are dissolved in 300 ml. of methanol at 130° F;

(B) 46 grams of formic acid are slowly added to the mixture of (A) with stirring and the temperature maintained at 140° F to 150° F;

(C) The product of (B) is dried at ambient conditions to remove excess methanol.

EXAMPLE II

A dryer-added fabric softening article is prepared by sprinkling 4.0 grams of the pure stearyl amine formate obtained in Example I uniformly over the surface of a 10 inch by 11 inch piece of air-laid, nonwoven cloth comprising 70% regenerated cellulose (American Viscose Corporation) and 30% hydrophobic binder-resin (RHoplex HA-8). The cloth has a thickness of 4 to 5 mils, a basis weight of about 24 grams per square yard and an absorbent capacity of 6. A one-foot length of the cloth, 8-⅓ inches wide, weights about 1.78 grams. The fibers in the cloth are about ¼ inch in length, 3.0 denier, and are oriented substantially haphazardly. The substrate cloth is 10 inches by 11 inches. The coated cloth is transferred to a heated plate, whereupon the composition melts and impregnates the interfiber free space in the cloth substrate. The article is removed from the hot plate and allowed to cool to room temperature, whereby the composition solidifies. The cloth retains its flexibility.

Following solidification of the softening composition, the cloth is slitted with a knife. Conveniently, the cloth is provided with 5 to 9 rectilinear slits extending along one dimension of the substrate, said slits being in a substantially parallel relationship and extending to within about one inch from at least one edge of said dimension of the substrate. The width of an individual slit is about 0.2 inch.

EXAMPLE III

An article prepared as in Example II is placed in an automatic clothes dryer together with 5 lbs. of freshly washed, damp (Ca. 5.5 lbs. water) mixed cotton, polyester and polyester/cotton blend fabrics. The automatic dryer is operated at an average temperature of 60° C for a period of 45 minutes. During the course of the drying operation the fabrics and the softener article are constantly tumbled together by the rotation of the dryer drum. After the drying cycle, the clothes are removed from the dryer and graded for fabric conditioning. The fabrics are found to have excellent softness and antistatic properties. Additionally, the degree of paint softening is minimal.

To the article as described in Example II can be added additional softeners, such as ditallow dimethyl ammonium methyl sulfate or sorbitan monostearate, with results similar to those described above for the formate salt alone being obtained.

What is claimed is:

1. An article of manufacture adapted for providing fabric softening within an automatic clothes dryer, said article comprising:

(a) a fabric softening amount of a softening composition containing a formic acid salt of a long chain primary amine softener component , said long chain having from about 12 to 22 carbon atoms; and (b) a dispensing means which provides for release of said softening composition within an automatic laundry dryer at dryer operating temperatures.

2. An article according to claim 1 wherein the long chain group on the primary amine has from about 16 to 22 carbon atoms.

3. An article according to claim 1 wherein the softening composition contains from about 50% to 100% by weight of the formic acid salt material and additionally contains another softener/antistat agent comprising from about 0% to 5% by weight of the composition.

4. An article according to claim 3 wherein the additional softener/antistat agent is ditallow dimethyl ammonium methyl sulfate.

5. An article according to claim 3 wherein the additional softener/antistat agent is sorbitan monostearate or a mixture of sorbitan monostearate and ditallow dimethyl ammonium methyl sulfate.

6. An article according to claim 1 wherein the dispensing means comprises a flexible substrate in a sheet configuration having the softening composition releasably affixed thereto.

7. An article according to claim 6 wherein the flexible substrate has an absorbent capacity of from about 2 to 25 and wherein the softening composition is impregnated into the substrate to provide a weight ratio of softening composition to dry substrate ranging from about 10:1 to about 0.5:1

8. An article according to claim 7 wherein the substrate is a woven or nonwoven cellulosic, polyester or polyester/cellulosic cloth or paper and has an absorbent capacity of from about 2 to about 15.

9. An article according to claim 7 wherein the substrate is a foamed plastic sheet having an absorbent capacity of from about 15 to about 25.

10. An article according to claim 1 wherein the dispensing means is an aerosol device.

11. A method for imparting a softening and antistatic effect to fabrics in an automatic laundry dryer comprising commingling pieces of damp fabrics by tumbling said fabrics under heat in an automatic clothes dryer with an effective amount of a fabric softening composition comprising a formic acid salt of a long chain primary amine, said long chain having from about 12 to 22 carbon atoms.

12. The method of claim 11 wherein the long chain group on the primary amine has from about 16 to 22 carbon atoms.

13. The method of claim 11 wherein the softening composition contains from about 50% to about 100% of the formic acid salt and additionally contains from about 0% to about 50% of another fabric softener/antistat agent.

14. The method of claim 13 wherein the additional fabric softener/antistat agent is ditallow dimethyl ammonium methyl sulfate.

15. The method of claim 13 wherein the additional fabric softener/antistat is sorbitan monostearate or a mixture of sorbitan monostearate and ditallow dimethyl ammonium methyl sulfate.

16. The method of claim 11 wherein the composition is dispensed within the dryer from a flexible substrate sheet having the softener composition releasably affixed thereto.

17. The method of claim 16 wherein the dispensing means comprises a flexible substrate in sheet configuration having an absorbent capacity of from about 2 to about 25 and wherein the softening composition is impregnated into the substrate to provide a weight ratio of softening composition to dry substrate ranging from about 10:1 to about 0.5:1.

18. The method of claim 17 wherein the substrate is a woven or nonwoven cellulosic, polyester or polyester/cellulosic cloth or paper and has an absorbent capacity of from about 2 to about 15.

19. The method of claim 17 wherein the substrate is a foamed plastic sheet having an absorbent capacity of from about 15 to about 25.

20. The method of claim 11 wherein the softener/antistat composition is dispensed into the dryer from an aerosol dispensing device.

21. A method for imparting a softening and antistatic effect to fabrics during the rinse cycle of an automatic clothes washer comprising adding to the washer at the start of the rinse cycle a flexible substrate having an effective amount of a fabric softening composition comprising a formic acid salt of a long chain primary amine releasably attached thereto, said long chain having from about 12 to 22 carbon atoms.

* * * * *

UNITED STATES PATENT AND TRADEMARK OFFICE

CERTIFICATE OF CORRECTION

PATENT NO. : 4,077,891

DATED : March 7, 1978

INVENTOR(S) : Wayne E. Beimesch and Michael A. Walsh

It is certified that error appears in the above-identified patent and that said Letters Patent are hereby corrected as shown below:

Col. 13, line 42, before "be" insert -- easily --.

Col. 17, line 16, "5%" should be -- 50% --.

Signed and Sealed this

*First* Day of *August 1978*

[SEAL]

*Attest:*

RUTH C. MASON
*Attesting Officer*

DONALD W. BANNER
*Commissioner of Patents and Trademarks*